US006219920B1

(12) United States Patent
Klein

(10) Patent No.: US 6,219,920 B1
(45) Date of Patent: Apr. 24, 2001

(54) DRY SHAVING APPARATUS

(75) Inventor: Martin Klein, Kelkheim (DE)

(73) Assignee: Braun GmbH, Frankfurt am Main (DE)

( * ) Notice: Subject to any disclaimer, the term of this patent is extended or adjusted under 35 U.S.C. 154(b) by 0 days.

(21) Appl. No.: 09/626,783

(22) Filed: Jul. 27, 2000

Related U.S. Application Data

(62) Division of application No. 09/052,617, filed on Mar. 31, 1998, now Pat. No. 6,151,780.

(51) Int. Cl.[7] ..... B26B 19/04
(52) U.S. Cl. ..... 30/43.92; 30/346.51
(58) Field of Search ..... 30/43.92, 346.51, 30/43.91, 43.9

(56) References Cited

U.S. PATENT DOCUMENTS

| | | | |
|---|---|---|---|
| 3,263,105 | 7/1966 | Hoyek . | |
| 3,594,902 | 7/1971 | Otto . | |
| 3,872,587 | 3/1975 | Wollinger . | |
| 5,632,087 * | 5/1997 | Motohashi et al. | 30/43.92 |
| 5,678,312 * | 10/1997 | Watanabe | 30/43.92 |

FOREIGN PATENT DOCUMENTS

| | | |
|---|---|---|
| 228677A | 12/1962 | (AT) . |
| 2236276A | 2/1973 | (DE) . |
| 53-63160 | 6/1978 | (JP) . |
| 53-63161 | 6/1978 | (JP) . |
| 53-63162 | 6/1978 | (JP) . |
| 54-85860 | 7/1979 | (JP) . |

* cited by examiner

*Primary Examiner*—Douglas D. Watts
(74) *Attorney, Agent, or Firm*—Fish & Richardson P.C.

(57) ABSTRACT

The invention is directed to a dry shaving apparatus, with an electric motor arranged in a housing and with at least one shaving head comprising two inner cutters which are operatively associated with a common outer cutter and are arranged to be driven in relative opposite directions by a drive element against the force of at least one spring element, wherein the inner cutters and the spring element are guided for movement in relative opposite directions by means of a common guide element, the guide element is carried in bracket elements, and the inner cutters are adapted to be acted upon by drive elements movable in relative opposite directions.

22 Claims, 15 Drawing Sheets

Fig. 1.1

DRY SHAVING APPARATUS

This case is a divisional case of Ser. No. 09/052,617, filed on Mar. 31, 1998, now U.S. Pat. No. 6,151,780.

This invention relates to a dry shaving apparatus, with an electric motor arranged in a housing and with at least one shaving head comprising two inner cutters which are operatively associated with a common outer cutter and are arranged on a common guide element so as to be drivable by a drive element in relative opposite directions against the force of at least one spring element.

From JP 53-63610 (A) a shaving head for a dry shaving apparatus is known in which two inner cutters are slidably guided on two guide elements and drivable in relative opposite directions by an eccentric device disposed between adjacent end walls of the inner cutters, said inner cutters being held in engagement with the eccentric device by means of two spring elements provided outside the contour of the inner cutters.

It is an object of the present invention to improve upon a dry shaving apparatus of the type initially referred to, in particular to provide a dry shaving apparatus in which vibration and running noise are largely reduced and which affords economy of manufacture.

According to the present invention, this object is accomplished in a dry shaving apparatus of the type initially referred to by the features indicated in claim 1.

The drive mechanism of the present invention which sets the two inner cutters in vibration has a plurality of advantages. The drive mechanism is a self-contained power system which, by reason of its arrangement relative to the housing in a manner imposing zero force, is prevented from transmitting vibrations to the housing. Being completely counterbalanced, the drive mechanism operates in vibration-free fashion. The drive mechanism with its components is not affected by manufacturing tolerances and wear. The spring element(s) acting on the inner cutters, in conjunction with the drive elements driven by the electric motor, provide for permanent compensation for tolerances, converting the kinetic energy of the inner cutters into useful potential energy. In consequence, the drive mechanism consumes less energy than known drive mechanisms setting inner cutters in motion. In cases where a rotary motor is used, the cutting frequency of the inner cutters can be doubled when used in combination with an elliptically shaped rotor. In addition, the drive mechanism is characterized by significantly reduced noise because the spring elements provided also compensate for wear occurring on movable components. Another advantage of the present invention resides in that it is suitable for use in a plurality of dry shavers with different configurations of shaving heads or cutter assemblies. The drive mechanism of the present invention is suited for use in dry shaving apparatus equipped with both one shaving head and several shaving heads. The shaving heads as such may be configured exclusively as short-hair cutters or as long-hair trimmers, and they may be used as a combination of short-hair cutter and long-hair trimmer and driven by the drive mechanism of the present invention. Moreover, it is possible for the shaving heads to be arranged in both fixed and pivotal and floating fashion on the housing of a dry shaving apparatus or in a shaving head frame mountable on the housing of a dry shaver.

In a further configuration of the present invention, provision is made for the guide element to be formed by an axle. In a preferred embodiment of the present invention, the guide element is formed by a single axle. In an embodiment of the present invention, the axle forming the guide element is preferably carried with the inner cutters in two bracket elements. The use of bracket elements for carrying the axle of the guide element admits of a plurality of different embodiments within the scope of the present invention. An embodiment of the present invention provides for the axle of the guide element to be movably carried in the bracket elements. Movable within the meaning of this invention is understood to mean any direction of movement and any type of movement.

In a preferred embodiment of the present invention, the axle of the guide element is carried in the bracket elements so as to be movable in and in opposition to a vertical direction. This vertical movability of the axle makes it possible, for example, to control the contact pressure necessary to achieve an optimum cutting action as the inner cutters engage the outer cutter, or in another embodiment, to mount the shaving head or any of the shaving heads provided in a floating fashion in and in opposition to the vertical direction.

In a further embodiment of the present invention, the bracket elements are spring-mounted, making it possible to control either the contact pressure of the inner cutters against the outer cutter as described in the foregoing, or a floating movement of the shaving head(s) in and in opposition to a vertical direction.

In an embodiment of the present invention affording relative ease and economy of manufacture, the bracket elements are fixedly arranged on the housing.

In a preferred embodiment of the present invention, a wall element upon which a spring element takes support is provided in each of the inner cutters. In a preferred embodiment of the present invention, a spring element acting in opposition to the driving motion of the drive elements is provided between the two inner cutters. In another embodiment of the present invention, each inner cutter is associated with a spring element resting with one end against a wall element of the inner cutter while its other end is in frictional or positive engagement with the guide element. In a further aspect of this embodiment, the frictional engagement of the spring element with the guide element is made by a stop on the guide element. By means of the frictional engagement of the spring element with the guide element directly, or indirectly by a stop on the guide element, it is ensured that vibrations of the reciprocated masses of the inner cutters are not transmitted to the housing of the dry shaving apparatus. In order to positively preclude any transmission of vibrations to the housing, a further aspect of this embodiment makes provision for a spacing between each bracket element and the adjacent stop on the guide element, thus precluding contact of the stop with the bracket element.

In a preferred embodiment of the present invention, each inner cutter is associated with a spring element resting with one end against a wall element of the inner cutter while its other end bears against a common supporting element. The supporting element of the present invention is adapted to be coupled to the guide element in self-centering fashion. In a preferred embodiment of the present invention, the supporting element is a yoke structure slidably coupled to the guide element by means of bearings provided in the two yoke ends. This embodiment of the present invention is eminently suited to ensure at all times self-centering of the inner cutters set in vibration utilizing the spring element(s) acting on the inner cutters as well as the drive elements having one end thereof in engagement with the wall elements of the inner cutters while their other ends engage the expansion means driven by the electric motor.

In an embodiment of the present invention, a wall element for the drive element is provided in each of the inner cutters. Preferably, a wall element of an inner cutter is adapted to be acted upon by the drive element on the one hand and by the spring element on the other hand. Using a wall element as supporting element for the spring element and simultaneously as abutment for the drive element has the effect of reducing the mass of the two inner cutters to a relatively low level.

In an embodiment of the present invention, the spring element acting on the inner cutters is configured as a compression spring. In another embodiment of the present invention, the spring element acting on the inner cutters is configured as an extension spring. In all embodiments of the invention, the spring elements serve as energy storage converting the kinetic energy of the inner cutters into usable potential energy following motion reversal of the two inner cutters. In addition, the spring tension, in particular a given bias of these spring elements, makes sure that tolerances are permanently compensated for.

The movement in relative opposite directions of the inner cutters along the axle serving as guide element against the force of at least one spring element is effected by drive elements which admit of a variety of embodiments. In one embodiment, the drive element is configured as a single-armed lever arranged for pivotal movement about a pin. In another embodiment, the drive element is configured as a double-armed lever arranged for pivotal movement about a pin. A feature common to these two embodiments is that the pin of each pivotally mounted drive element is essentially provided on a vertical line determined by an imaginary extension of a plane wall surface of a wall element of an inner cutter, which wall surface is acted upon by a roll-off cam.

In order to largely preclude friction in the transmission of motion from the drive elements to the inner cutters, the drive element is configured as a lever acting via a roll-off cam on a wall element of the inner cutter. In a preferred embodiment of the present invention, the roll-off cam is provided on the drive element configured as lever. In an alternative aspect of this embodiment, the roll-off cam is provided on the wall element of the inner cutter.

In an embodiment of the present invention, the roll-off cam is of a symmetrical configuration. In a further embodiment of the present invention, the roll-off cam is of an asymmetrical configuration. The respective curve shape of the roll-off cam is influenced by an expansion means driven by the electric motor and releasing the lever action of the drive elements. In cases where a rotor with an elliptically shaped outer wall is utilized for control of the reciprocating motion of the drive levers acting on the two inner cutters, a symmetrical roll-off cam is preferred at the ends of the drive elements engaging the inner cutters.

A further advantageous embodiment of the present invention is characterized in that the drive element is configured as an oscillatory bridge structure. In a further aspect of this embodiment, the drive element is formed by at least two oscillatory bridge structures of identical construction having vibration elements operating in relative opposite directions. For manufacture of the oscillatory bridge structures setting the inner cutters in motion in relative opposite directions, only one injection mold is necessary by reason of the selection of an identical construction, enabling the cost of manufacture to be kept low.

In another advantageous embodiment, an oscillatory bridge structure having at least two vibration elements movable in relative opposite directions is provided. Further advantageous configurations of the oscillatory bridge structures suitable for use as drive elements including their associated expansion means are indicated in claims 32 to 36.

In a preferred embodiment of the present invention, an expansion means driven by an electric motor is provided between two adjacent ends of the drive elements pivotally mounted about their respective pins. The electric motor is preferably a direct-current motor. In a preferred embodiment of the present invention, the expansion means is formed by a rotor having an elliptical guideway for the transmission of motion to the drive elements. An alternative aspect of this embodiment is characterized in that the expansion means is formed by a crank drive mechanism.

To ensure a good engagement of the inner cutters with the outer cutter and hence obtain good cutting results, the inner cutters are held against the outer cutter by means of at least one spring element. In a further aspect of this approach, the inner cutters are held in engagement with the outer cutter by spring-mounting the bracket elements.

In yet another embodiment, each inner cutter is held in engagement with the outer cutter by means of a spring element resting against a housing wall. In an embodiment of the present invention, the outer cutter is movably mounted. The movability of the outer cutter may be achieved by movably securing the outer cutter in a shaving head frame mountable on the housing of the dry shaver, or by movably arranging it in an outer cutter frame, or by movably arranging an outer cutter frame with the outer cutter. In a further aspect of this embodiment, the outer cutter is pivotally mounted. In a still further embodiment, the outer cutter is floatingly mounted in and in opposition to the vertical direction. Mounting the outer cutter movably ensures either a good engagement of the outer cutter with the inner cutters, that is, a good cooperation between these two cutting members, or the formation of movable shaving heads such that these shaving heads are pivotal about a pivot axis or, in another variant, are movable up and down in the shaving head frame or on the housing of the dry shaving apparatus in and in opposition to a vertical direction.

In a preferred embodiment of the present invention, the spring element is arranged on the guide element formed by an axle. This arrangement provides for clearly defined allocation and supporting of the spring element relative to the drive mechanism and the reciprocable inner cutters. In a further embodiment of the present invention, at least one guide element configured as an axle is held in a frame carried in the bracket elements. In another aspect of this embodiment, the frame is pivotally mounted in the bracket elements. In another embodiment of the present invention, at least one axle is floatingly carried in the frame.

Some preferred embodiments of the present invention will be described in more detail in the following with reference to the accompanying drawing. In the drawing, FIG. 1 is a sectional view of the upper part of a dry shaving apparatus with two inner cutters arranged on a guide element and drivable in relative opposite directions by two pivotally mounted drive elements under the action of an expansion means driven by an electric motor against the force of a spring element, with the guide element being mounted in bracket elements fixedly disposed on the housing;

FIG. 1.1 is a view of an expansion means configured as a rotor;

Figure 1:
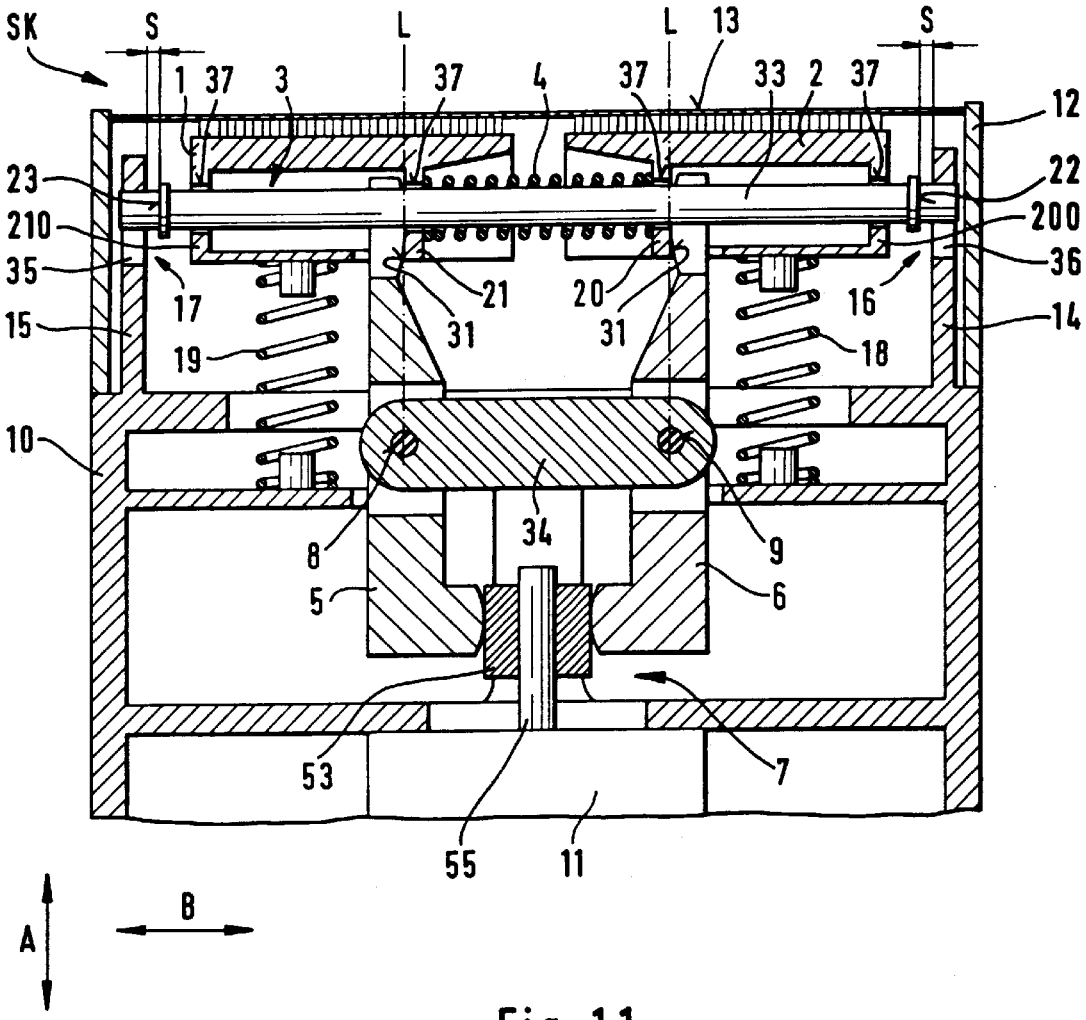
Figure 1:
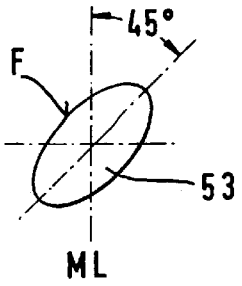

Referring now to FIG. 1 of the drawing, there is shown a dry shaving apparatus with an electric motor 11 received in a housing 10 and with at least one shaving head SK comprising two inner cutters 1 and 2 operatively associated with a common outer cutter 13 and arranged to be driven by a drive element 5 and 6, respectively, in relative opposite directions and against the force of at least one spring element 4. The inner cutters 1 and 2 are slidably guided on a common guide element 3 in and in opposition to a horizontal direction B—directions of arrow B—by means of two wall elements 21 and 210 and, respectively, by means of two wall elements 20 and 200. The guide element 3 is configured, for example, as an axle 33 and, for the purpose of ensuring a perfect guiding function for the two inner cutters 1 and 2, is passed through bearing bores 37 provided in the wall elements 20, 21, 200 and 210. A spring element 4 configured as a compression spring is disposed between the two opposite wall elements 20 and 21 of the inner cutters 1 and 2. The drive elements 5 and 6 configured as double-armed levers have roll-off cams 31 integrally formed thereon through which they act on the side of the wall elements 20 and 21 facing away from the spring element 4. The curvature of the roll-off cam 31 is of such shape that no relative sliding motion occurs on the wall upon which it acts. The two double-armed drive elements 5 and 6 are mounted for pivotal movement about pins 8 and 9, respectively, which are provided on a pin support 34. An expansion means 7 admitting of a variety of embodiments is provided between the ends of the drive elements 5 and 6 remote from the inner cutters. The embodiment of FIG. 1 comprises a rotor 53 which is fastened to the motor shaft 55 of an electric motor 11 and whose outer wall engaged by the drive elements 5 and 6 is of an elliptical shape as illustrated in FIG. 1.1. The outer wall of the rotor 53 which serves as a guideway and is in abutment with a respective lever end of the drive elements 5 and 6 is designated by F. FIG. 1.1 is a view of the rotor 53 as seen when rotated through 45° from a mid-position ML. This position of the rotor 53 is maintained in all embodiments shown in which a rotor 53 is provided. This position corresponds to the mid-position of the inner cutters 1, 2 in the course of their oscillation in the horizontal direction B.

The guide element 3 configured as axle 33 is movably carried in bearings 16 and 17 provided in two bracket elements 14 and 15 integrally formed on the housing 10, with the bearings 16 and 17 of the axle 33 in the bracket elements 14 and 15 being formed of elongate recesses 35 and 36 extending in a vertical direction A—direction of arrow A. Because the axle 33 is movable within the elongate recesses 35 and 36, an optimum engagement of the two inner cutters 1 and 2 with the outer cutter 13 is ensured, assisted by the action of the spring elements 18 and 19 bearing against the inner cutters. In addition, the up and down movement of the axle 33 with the inner cutters 1 and 2 slidably arranged thereon in the directions B, which movement is made possible by means of the elongate recesses 35 and 36, in combination with a movably disposed outer cutter 13, may be utilized for a floating shaving head SK.

For such an embodiment it is only necessary for the outer cutter 13 to be secured in the shaving head frame 12 detachably mounted on the housing 10 such as to be movable in the vertical direction A, or for the outer cutter 13 to be provided in an outer cutter frame that is vertically movably arranged in the shaving head frame 12.

Provided on the guide element 3 or axle 33 are stops 22 and 23 which, upon assembly of the drive mechanism, are spaced from the two bracket elements 14 and 15 at a predetermined distance S. This spacing S is dimensioned such as to preclude contact of the stops 22 and 23 with the respective bracket elements 14 and 15 during operation of the dry shaving apparatus.

In the embodiment of FIG. 1, the two drive elements 5 and 6 pivotally mounted about their pins 8 and 9, respectively, have a respective lever end thereof in engagement with the elliptically shaped outer wall F of the rotor 53, while their roll-off cams 31 formed on the opposite lever ends engage the wall elements 20 and 21 of the inner cutters 1 and 2, zero play of this latter engagement being ensured by virtue of the biasing force of the compression spring element toward the wall elements 20 and 21. The respective pins 8 and 9 of the pivotally mounted drive elements 5 and 6 are each arranged on a vertical line L determined by an imaginary extension of a plane wall surface of the wall elements 20 and 21 of the inner cutters 1 and 2, which wall surface is acted upon by the roll-off cam 31 and has an orientation perpendicular to the direction of movement of the inner cutters. By means of such a structural design and cooperative relationship of the individual components of the drive mechanism, the two inner cutters 1 and 2 movable in relative opposite directions on the axle 33 serving as guide element 3 are combined to form a self-contained power system which in operation does not permit any contact with the stops 22 and 23 and/or the bracket elements 14 and 15 and, in consequence, does not permit the transmission of any vibration of the oscillating inner cutters to the housing 10 after they are set in operation. This self-contained power system centers itself automatically on the axle 33 forming the guide element 3, ensuring by means of the biased spring element 4 that any manufacturing tolerances of the components of the drive mechanism are compensated for, consequently causing the drive mechanism to operate without producing any rattling noise.

Figure 2:
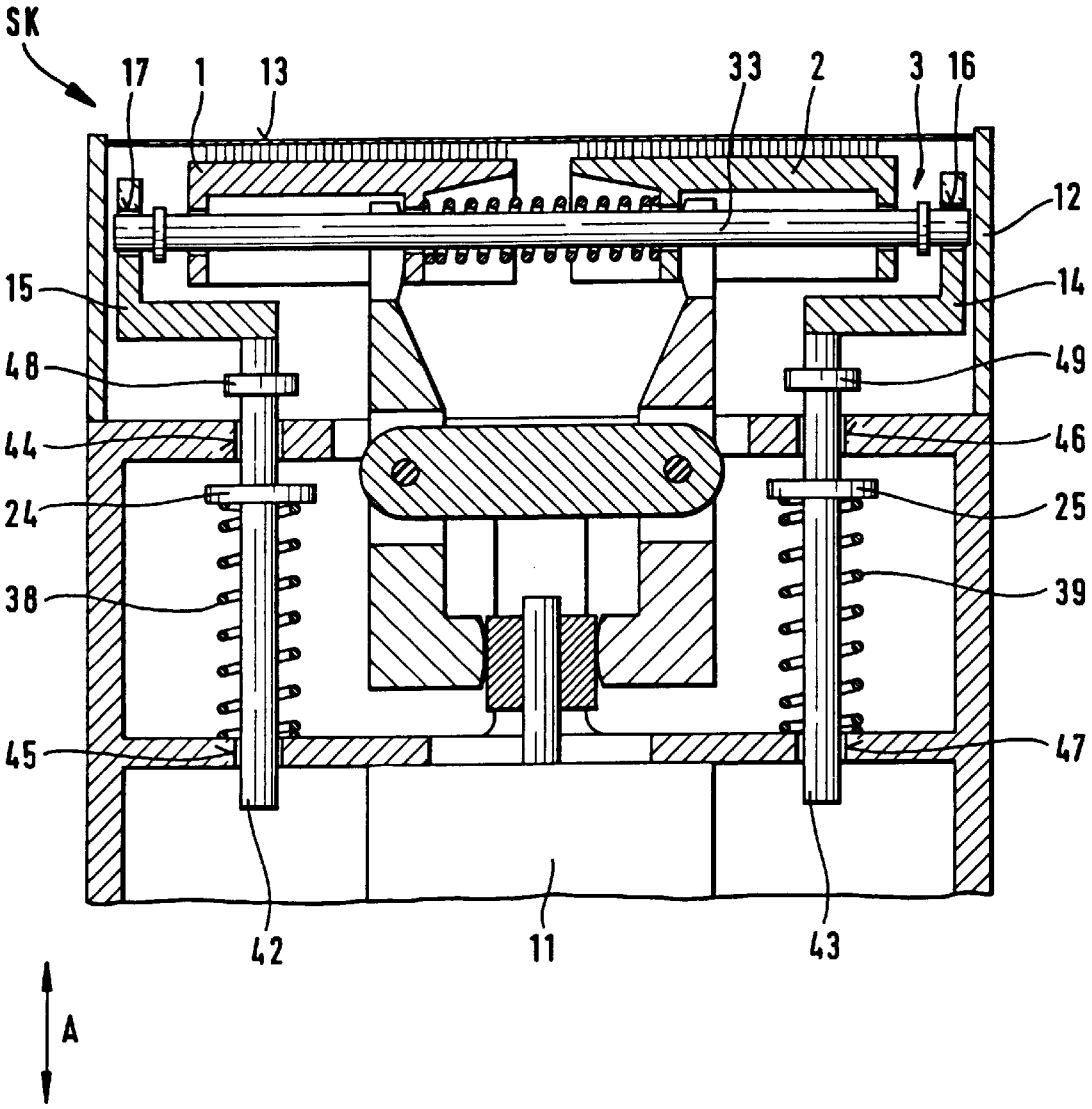
FIG. 2 is a sectional view of a dry shaving apparatus of FIG. 1, showing the guide element carried in spring-mounted bracket elements.

The embodiment of the dry shaving apparatus of FIG. 2 differs from the embodiment of FIG. 1 substantially in that the two bracket elements 14 and 15 are spring-mounted in the housing 10 of the dry shaving apparatus. For this purpose, a respective stop 24 and 25 is provided on the bracket elements 14 and 15 projecting into the housing 10 by means of rods 42 and 43, such that the bracket elements 14 and 15 are movable in and in opposition to a vertical direction A, under the action of springs 38 and 39 bearing with one end against the stops 24 and 25 while their other ends take support upon an inner wall of the housing 10. To ensure a parallel guiding of the two rods 42 and 43 and hence of the bracket elements 14 and 15, the rods 42 and 43 are guided in bearing bores 44, 45, 46, 47 correspondingly provided in two adjacent walls of the housing 10. For the purpose of limiting the movability of the guide elements 14 and 15 in and in opposition to the vertical direction A, further stops 48 and 49 are provided on the rods 42 and 43, respectively, their relative distance to the stops 24 and 25 determining the maximum amount of spring travel taking into account the wall thickness of the housing 10 into engagement with which all the stops 24, 25, 48 and 49 are moved. The axle 33 forming the guide element 3 is carried in bearings 16 and 17 in the two bracket arms 14 and 15, the bearings being designed to admit of no movement of the axle 33 in and in opposition to the vertical direction A. Consequently, the springs 38 and 39 acting on the bracket elements 14 and 15 via the stops 24 and 25 can be utilized for urging the two inner cutters 1 and 2 against the outer cutter 13. In cases where the outer cutter 13 is movably arranged in the shaving head frame 12, the springs 38 and 39 may be used both for urging the two inner cutters 1 and 2 into engagement with the outer cutter 13 and for providing a floating bearing for a shaving head comprising an outer cutter 13 and inner cutters 1 and 2 in and in opposition to the vertical direction A.

Figure 3:
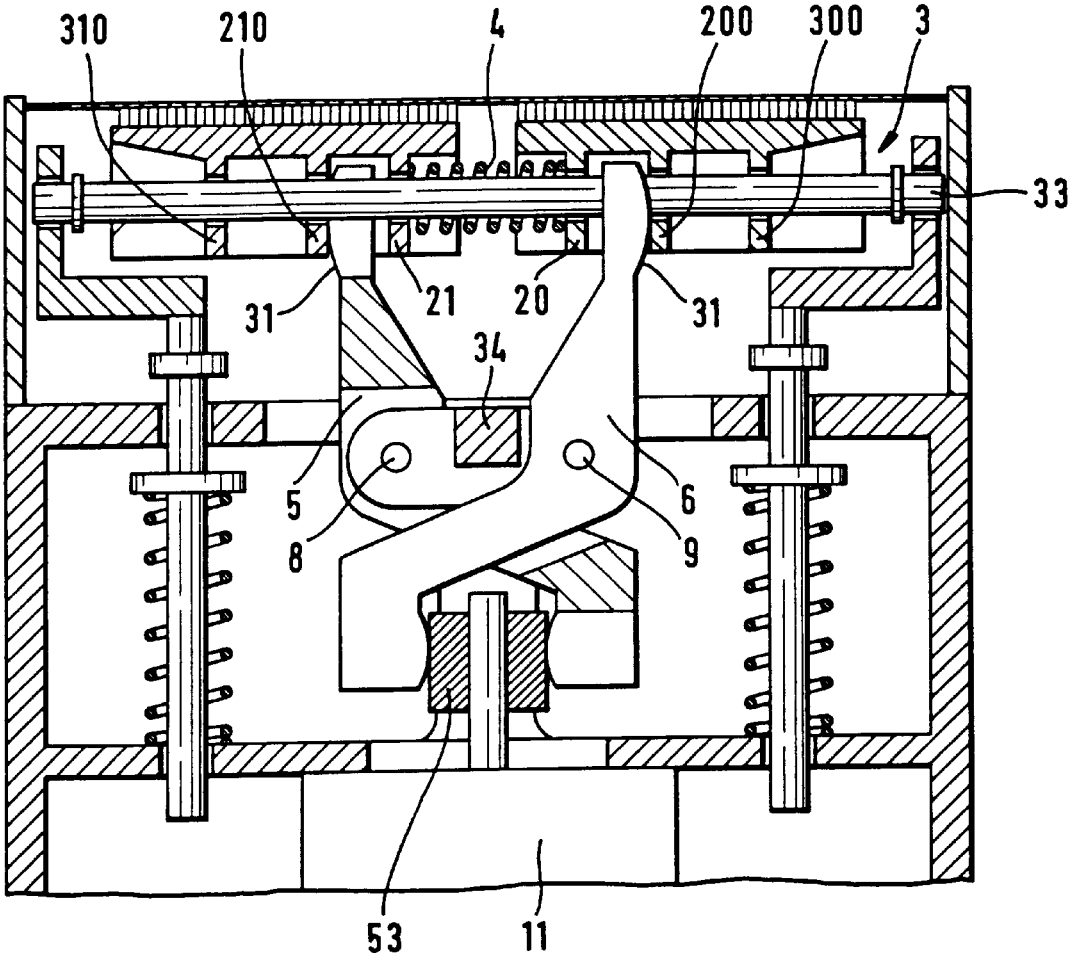
FIG. 3 is a view of a dry shaving apparatus of FIG. 2, showing drive elements arranged crosswise and a spring element configured as an extension spring acting on the two inner cutters.

The embodiment of a dry shaving apparatus of FIG. 3 differs from the embodiment of FIG. 2 essentially in that the drive elements 5 and 6 are mounted on the pin support 34 for pivotal movement about the pins 8 and 9 in a manner crossing each other. For motion transmission from the drive elements 5 and 6 to the inner cutters 1 and 2, wall elements 200 and 210 are provided in the inner cutters 1 and 2, such that under the action of the spring element 4 configured as an extension spring and arranged to be in positive engagement with the two wall elements 20 and 21 of the inner cutters 1 and 2, engagement of the roll-off cams 31 of the drive elements 5 and 6 with the wall elements 200 and 210 is ensured. In view of the relatively close proximity of the wall elements 20, 200 and 21, 210 of the two inner cutters 1 and 2 and making allowance for the longitudinal dimensions of the two inner cutters 1 and 2, a further wall element 300 and 310, respectively, is provided in the inner cutters 1 and 2, thereby ensuring good guidance and sliding motion of the two inner cutters on the axle 33 forming the guide element 3.

Similar to the spring element 4 of the embodiments of FIGS. 1 and 2 which is configured as a compression spring, the spring element 4 connected to the inner cutters 1 and 2 and configured as an extension spring ensures permanent relative engagement of all movable components of the drive mechanism, that is, engagement of the drive elements 5 and 6 with the wall elements of the inner cutters 1 and 2 and with the rotor 53 driven by the electric motor 11. This means that self-centering of the power-controlled system is ensured also in this embodiment by reason of the symmetry of all forces acting from outside.

Figure 4:
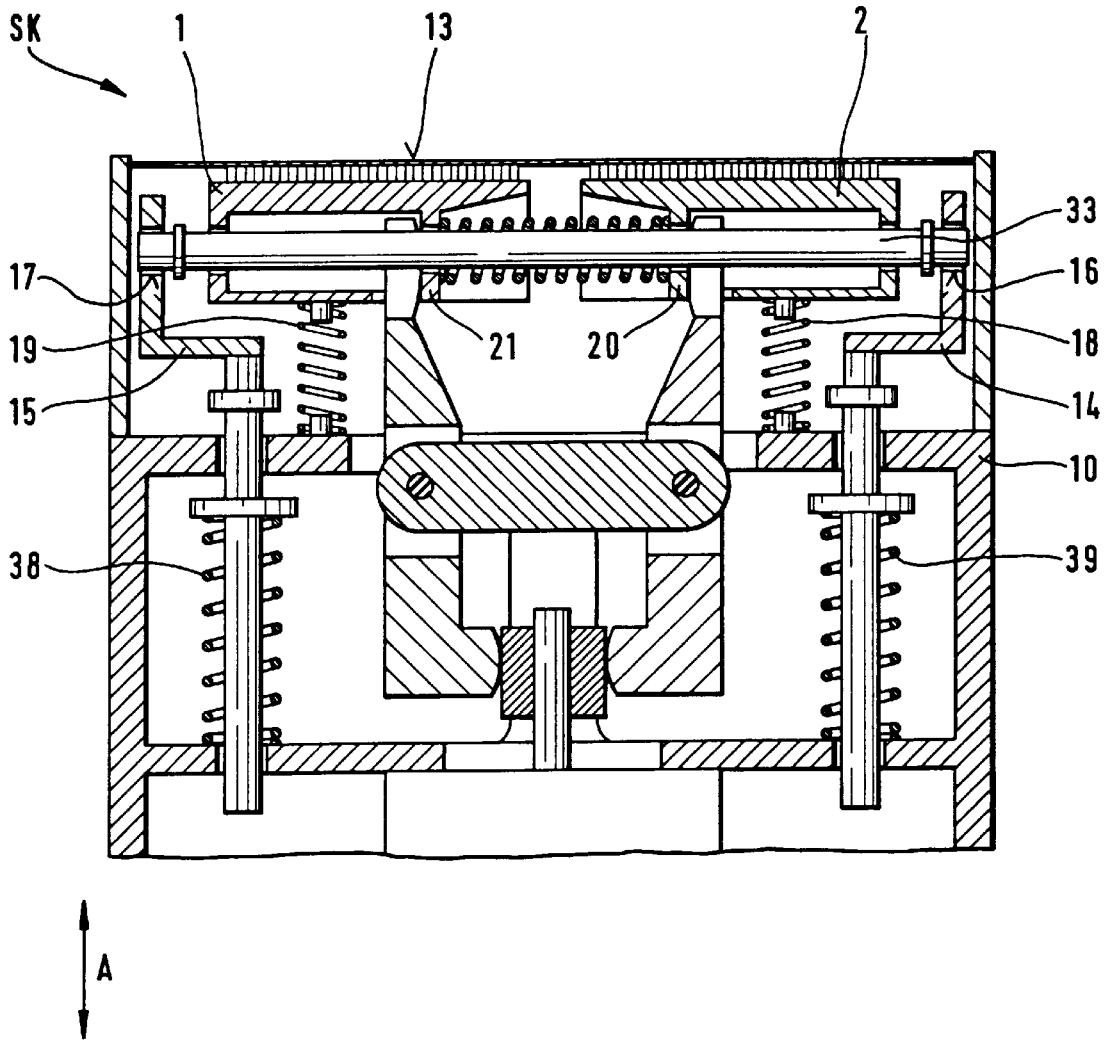
FIG. 4 is a view of a dry shaving apparatus of FIG. 2, showing a guide element, movably mounted bracket elements and spring elements acting on the two inner cutters.

The embodiment of the dry shaving apparatus of FIG. 4 largely corresponds to the embodiment of FIG. 2. In contrast to the embodiment of FIG. 2, in the embodiment of FIG. 4 the two inner cutters 1 and 2 are held in engagement with the outer cutter 13 by means of spring elements 18 and 19. The spring characteristic of the spring elements 18 and 19 differs from the spring characteristic of the springs 38 and 39. The spring elements 18 and 19 are weaker than the springs 38 and 39. As a result, the springs 18 and 19 bearing against a wall of the housing 10 effect a good engagement of the inner cutters 1 and 2 with the outer cutter 13 by exerting a low spring force on the inner cutters 1 and 2, in addition to substantially reducing the friction of the inner cutters 1 and 2 in their sliding movement on the axle 33. The springs 38 and 39 which are slightly stiffer serve to provide a floating bearing for a shaving head SK comprising the two inner cutters 1 and 2 and the outer cutter. The floating movement of the shaving head SK in and in opposition to the vertical direction A results from the action of contact forces applied to the outer cutter 13 and their transmission via the outer cutter 13 to the inner cutters 1 and 2 therewith engaged and onwards via the axle 33 carrying the two inner cutters 1 and 2 to the bracket elements 14 and 15, including the action of the springs 38 and 39 bearing with one end against the housing 10 and with their other end against the bracket elements.

Figure 5:
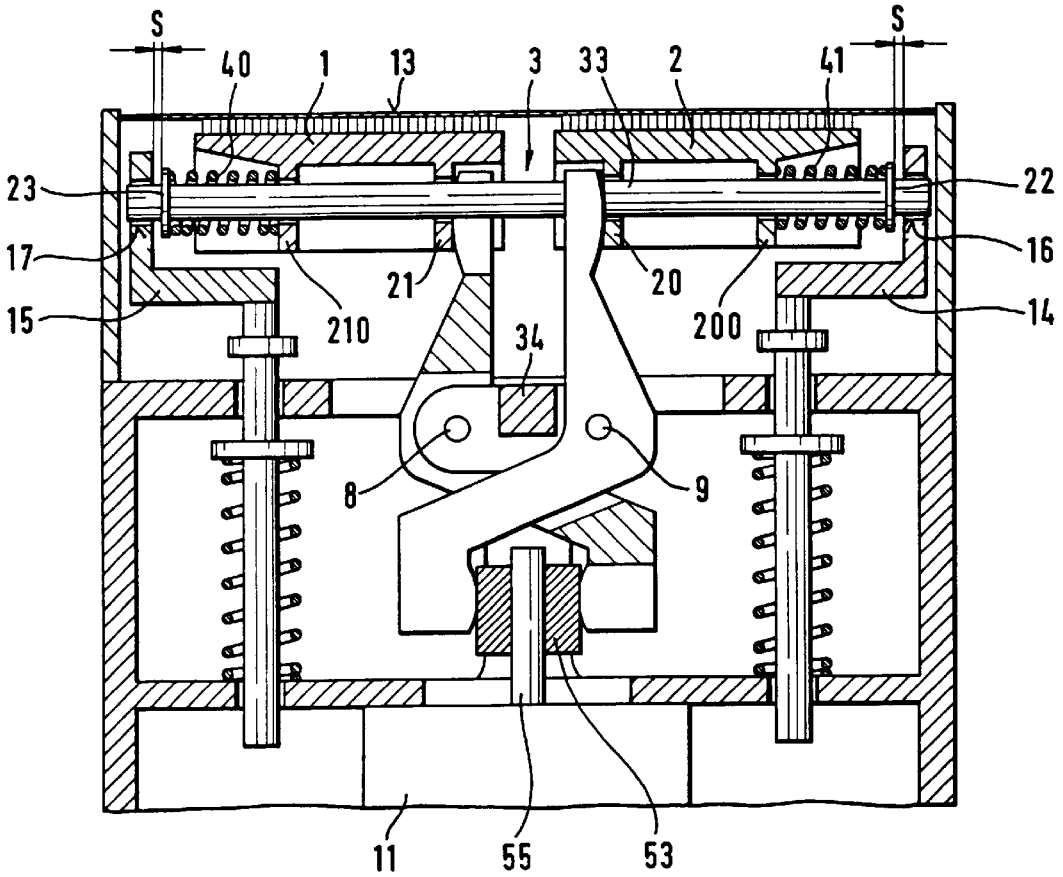
FIG. 5 is a view of a dry shaving apparatus of FIG. 3, showing inner cutters having their respective ends acted upon by a spring element.

The embodiment of the dry shaving apparatus of FIG. 5 corresponds largely to the structural design of the dry shaving apparatus of FIG. 3 from which it is distinguished by incorporating two spring elements in the form of compression springs acting on the inner cutters 1 and 2, in lieu of a single spring element 4 configured as an extension spring. Provided on the inside of the inner cutters are, for example, four wall elements 20, 21 and 200, 210, of which the wall elements 20 and 21 are acted upon by the drive elements 5 and 6 arranged crosswise.

Parallel to and at a predetermined distance from the wall elements 20 and 21 are two further wall elements 200 and 210 which are acted upon by a respective spring element 40 and 41 configured as a compression spring. The ends of the spring elements 40 and 41 on the side remote from the wall elements 200 and 210 act upon a respective stop 22 and 23 provided on the guide element 3 or the axle 33. The axle 33 is movably carried in bearings 16 and 17 formed as bearing bores in the bracket arms 14 and 15. A spacing S is maintained between the adjacent walls of the bracket arms 14 and 15 and the stops 22 and 23, its dimension being such as to preclude any contact of the stops 22 and 23 with the bracket arms 14 and 15 when the shaver is in operation.

The stops 22 and 23 represent only one embodiment of a support for the spring elements 40 and 41 on the guide element 3 or axle 33. In another embodiment, this support may also be obtained by connecting an end of the spring elements 40 and 41 to the guide element 3 or axle 33—not shown. When the electric motor is started, the rotary motion of the motor shaft 55 is transmitted via the rotor 53 to the two drive elements 5 and 6 pivotal about the pins 8 and 9, and via the roll-off cams provided on the drive elements 5 and 6 to the wall elements 20 and 21 of the inner cutters 1 and 2, thereby causing movement of the inner cutters 1 and 2 mounted on the guide element 3 against the pressure of the spring elements 40 and 41 in the direction of the bracket arms 14 and 15 until the motion is reversed as predetermined by the rotor 53, the energy stored in the spring elements 40 and 41 being then released after the motion reversal of the inner cutters 1 and 2 has taken place.

Figure 6:
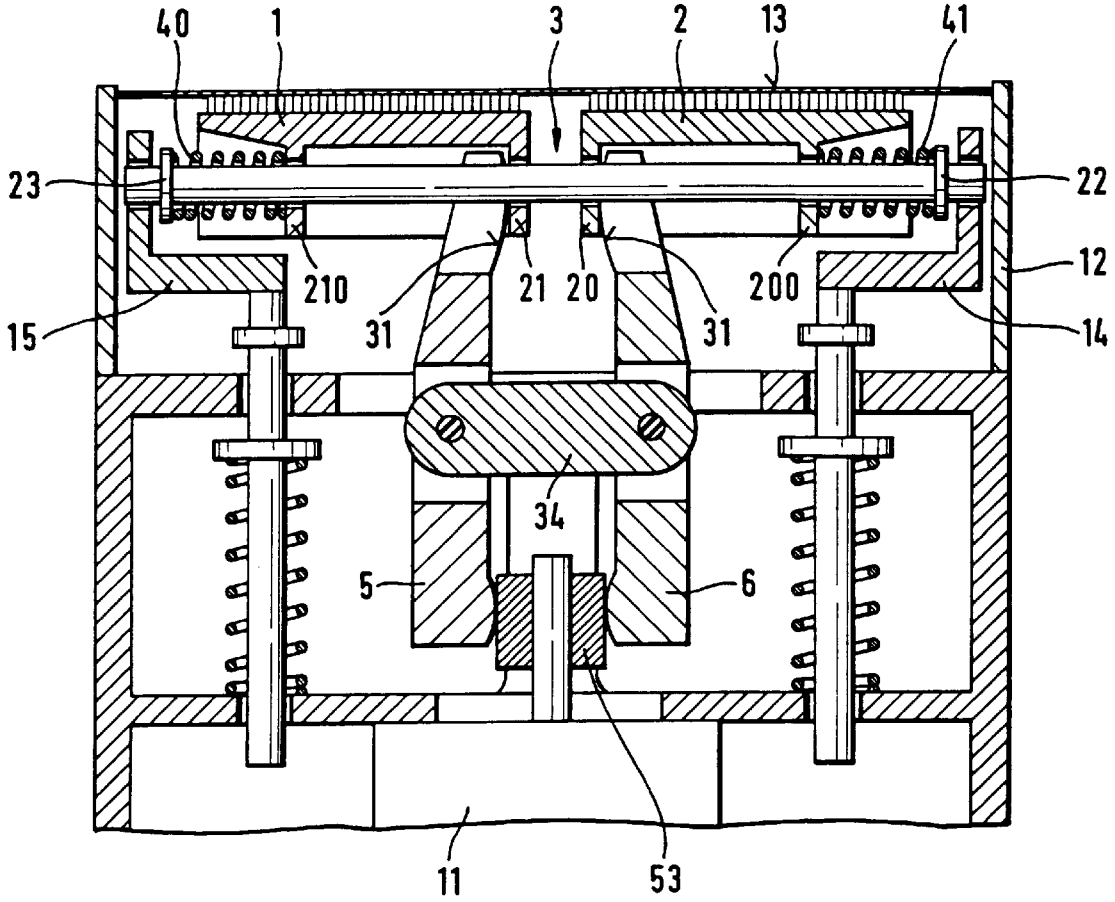
FIG. 6 is a view of a dry shaving apparatus substantially according to FIG. 5, showing two inner cutters having their respective ends acted upon by a spring element.

The embodiment of the dry shaving apparatus of FIG. 6 corresponds largely to the embodiment of the dry shaving apparatus of FIG. 5. The embodiment of the dry shaving apparatus of FIG. 5 is distinguished from the embodiment of FIG. 6 in that the embodiment of FIG. 6 incorporates spring elements 40 and 41 in the form of extension springs in lieu of the two spring elements 40 and 41 of FIG. 5 which are configured as compression springs. The spring element acting as extension spring element 40 has one end fixedly connected to the wall element 210 of the inner cutter 1 and its other end to the stop 23. By contrast, the spring element 41 acting as extension spring has one end thereof fixedly connected to the wall element 200 of the inner cutter 2 and its other end to the stop 22 of the guide element 3. The embodiment of FIG. 6 is further distinguished by incorporating, in lieu of the crosswise drive elements 5 and 6 of FIG. 5, two double-armed drive elements extending parallel to each other which are pivotally mounted on the pin support 34 by means of pins 8 and 9. The roll-off cams 31 of the drive elements 5 and 6 roll along the respective insides of the wall elements 20 and 21.

Figure 7:
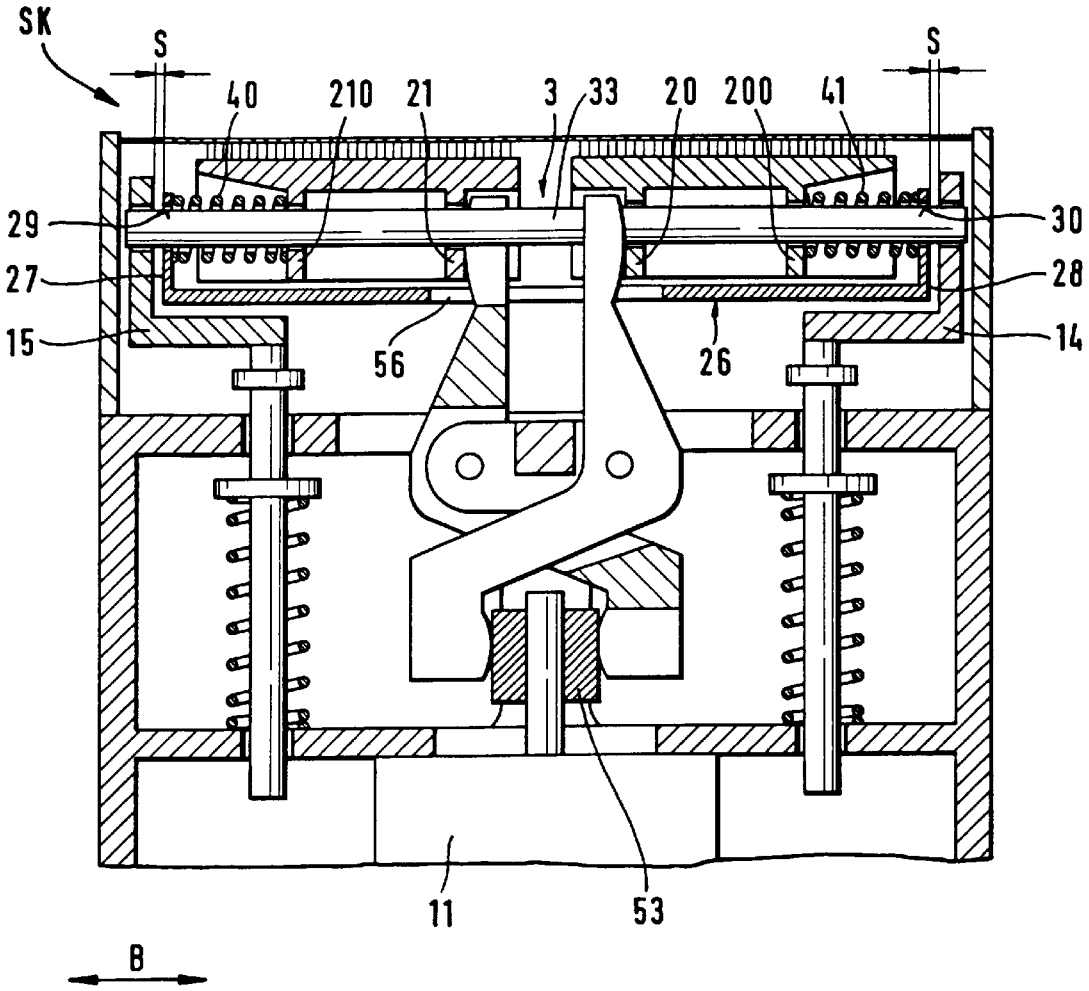
FIG. 7 is a view of a dry shaving apparatus of FIG. 5, showing two inner cutters and a U-shaped supporting element embracing the inner cutters, and spring elements disposed between the supporting element and the respective inner cutter.

While the embodiment of a dry shaving apparatus of FIG. 7 corresponds largely to the embodiment of FIG. 5, its essential difference resides in the provision of a supporting element 26 in lieu of the provision of stops 22 and 23 on the guide element 3. The supporting element 26 is a yoke structure embracing both inner cutters 1 and 2 and having in its yoke ends 27 and 28 bearings 29 and 30 configured as plain bearings by means of which the supporting element 26 is horizontally slidably arranged on the guide element 3 formed by an axle 33 in and in opposition to the directions B. To ensure the transmission of motion from the rotor 53 via the double-armed drive elements 5 and 6 to the wall elements 20 and 21 of the inner cutters 1 and 2, an opening 56, for example, is provided in the common supporting element 26 of the springs 40 and 41, through which opening the drive elements 5 and 6 are passed. In the embodiment of FIG. 7, the two spring elements 40 and 41 rest with one end against the wall elements 200 and 210 provided in the inner cutters 1 and 2 while their other ends take support upon the two yoke ends 27 and 28 of the supporting element 26. The guide element 3 formed by the axle 33 is passed through all wall elements 20, 200, 21, 210 of the inner cutters 1 and 2 and through the bearings 29 and 30 of the yoke ends 27 and 28 of the supporting element 26, and is movably held in the bracket elements 14 and 15. The spacing S maintained between the yoke ends 27 and 28 of the substantially U-shaped supporting element 26 and the two bracket elements 14 and 15 ensures an automatic self-centering of the supporting element 26 and the two inner cutters 1 and 2 on the guide element 3, compensating at the same time for any manufacturing tolerances of the components of the drive mechanism. The spacing S is of such dimension that it precludes any contact of the yoke ends 27 and 28 of the supporting element 26 with the bracket elements 14 and 15 when the shaving apparatus is in operation.

Figure 8:
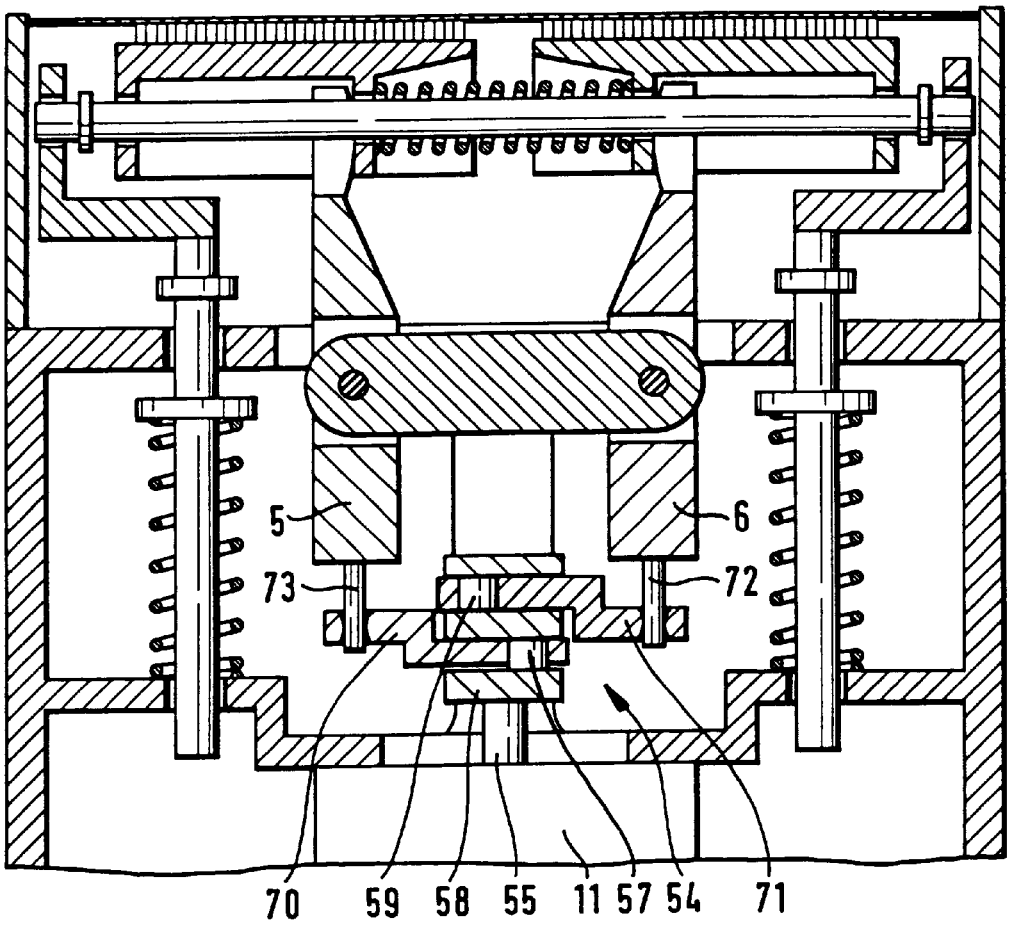
FIG. 8 is a view of a dry shaving apparatus of FIG. 2, showing an expansion means configured as a crank drive mechanism acting on the drive elements.

FIG. 8 shows an embodiment of a dry shaving apparatus corresponding largely to the embodiment of FIG. 2. The embodiment of FIG. 8 differs from the embodiment of FIG. 2 in that the two double-armed drive elements 5 and 6 are driven by the motor shaft of an electric motor 11 by means of a crank drive mechanism 54. The motor shaft 55 of the electric motor 11 is connected to a double eccentric device 58 having eccentric cams 57 and 59 to which respective crank levers 70 and 71 are hingedly connected, the drive elements 5 and 6 being connected by means of drive pins 72 and 73 engaging the crank levers 70 and 71.

Figure 9:
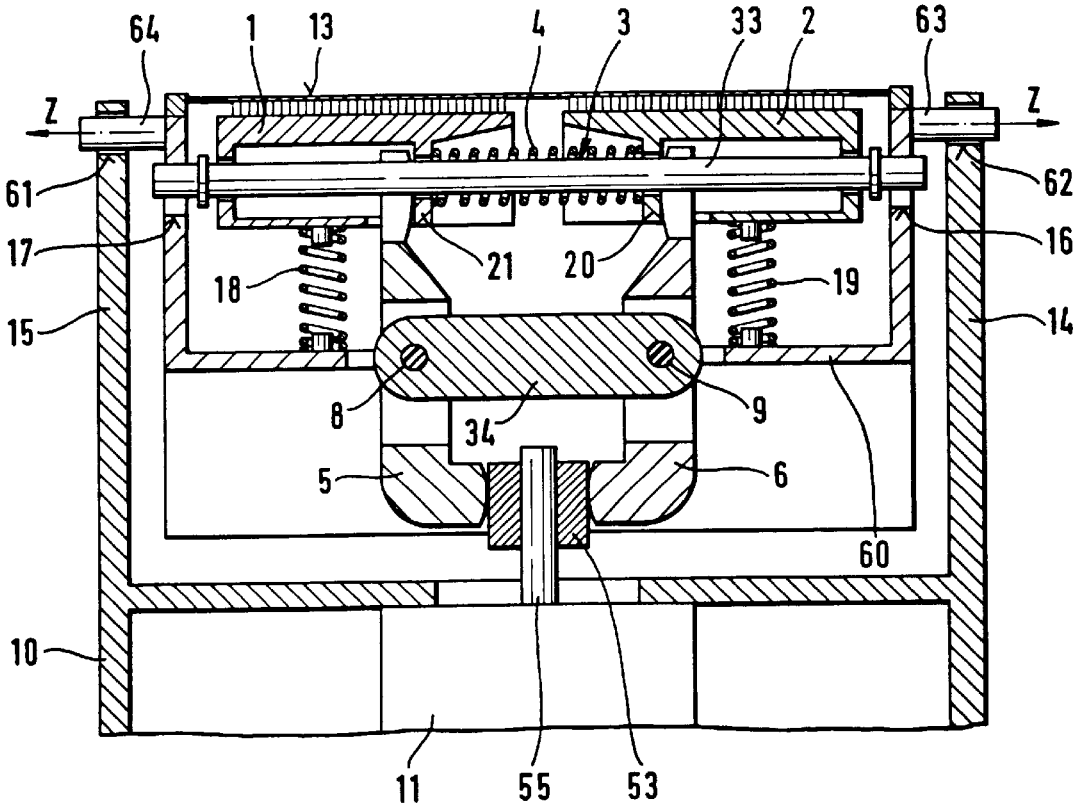
FIG. 9 is a view of a dry shaving apparatus with bracket elements provided on the housing and carrying a frame pivotal about a pivot axis Z, with the relatively movable inner cutters being held in the frame by means of a guide element.
Figure 12:
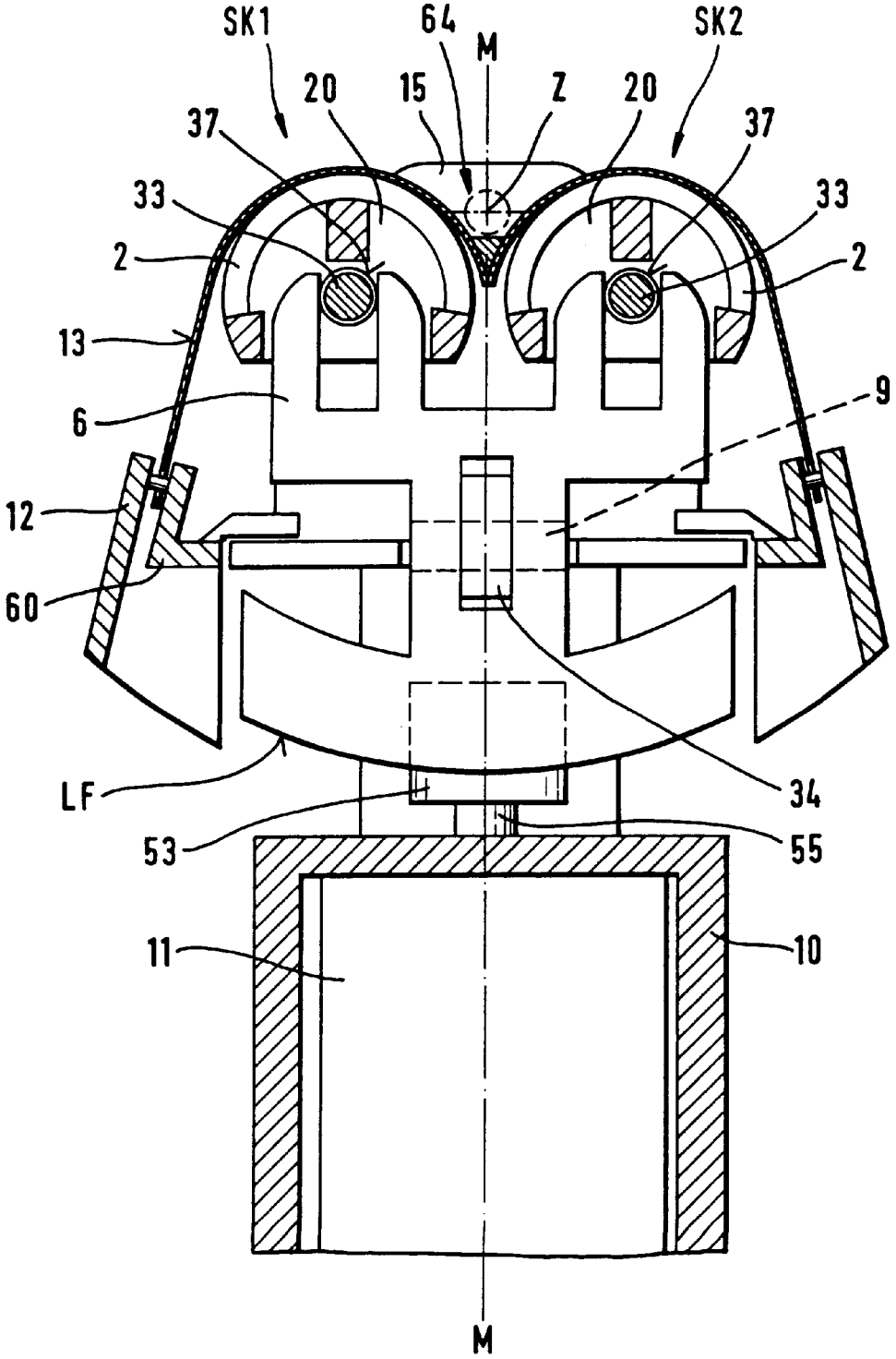
FIG. 12 is a sectional view of the upper portion of a dry shaving apparatus of FIG. 9, showing two shaving heads pivotally mounted about a pivot axis, with the parallel inner cutters being drivable by means of a common drive lever utilizing an expansion means.

The dry shaving apparatus of the embodiment illustrated in FIG. 9 corresponds to the embodiment of FIG. 1 as regards the drive means connected to the electric motor 11 for driving the two inner cutters 1 and 2 slidably mounted on the axle 33 forming the guide element 3 against the pressure of a spring element 4. In contrast to the embodiment of FIG. 1, a frame 60 is provided in which the guide element 3 is movably held in bearings 16 and 17. Spring elements 18 and 19 bearing with one end against a wall of the frame 60 and with their other end against the inner cutters 1 and 2 urge the inner cutters 1 and 2 into engagement with the outer cutter 13. In the embodiment of FIG. 9, the bracket elements 14 and 15 constitute part of the housing 10. Alternatively, however, they may also be detachably secured to the housing 10—not shown. Provided at the upper end of the bracket arms 14 and 15 are journal bearings 61 and 62. By means of journals 63 and 64 in the journal bearings 61 and 62, the frame 60 is mounted for pivotal movement about a pivot axis Z. As illustrated in FIG. 12, for example, the possibility exists to arrange in the frame 60 several shaving heads SK each having two inner cutters movable in relative opposite directions and operatively associated with at least one outer cutter, together with the spring elements 18 and 19. The frame 60 largely encompasses the drive mechanism for the inner cutters 1 and 2 formed of the drive elements 5 and 6 and the rotor and connected through at least one opening at least to the motor shaft 55 of the electric motor 11. Attached to the frame 60 is the pin support 34 carrying the pins 8 and 9 for the drive elements 5 and 6.

Figure 10:
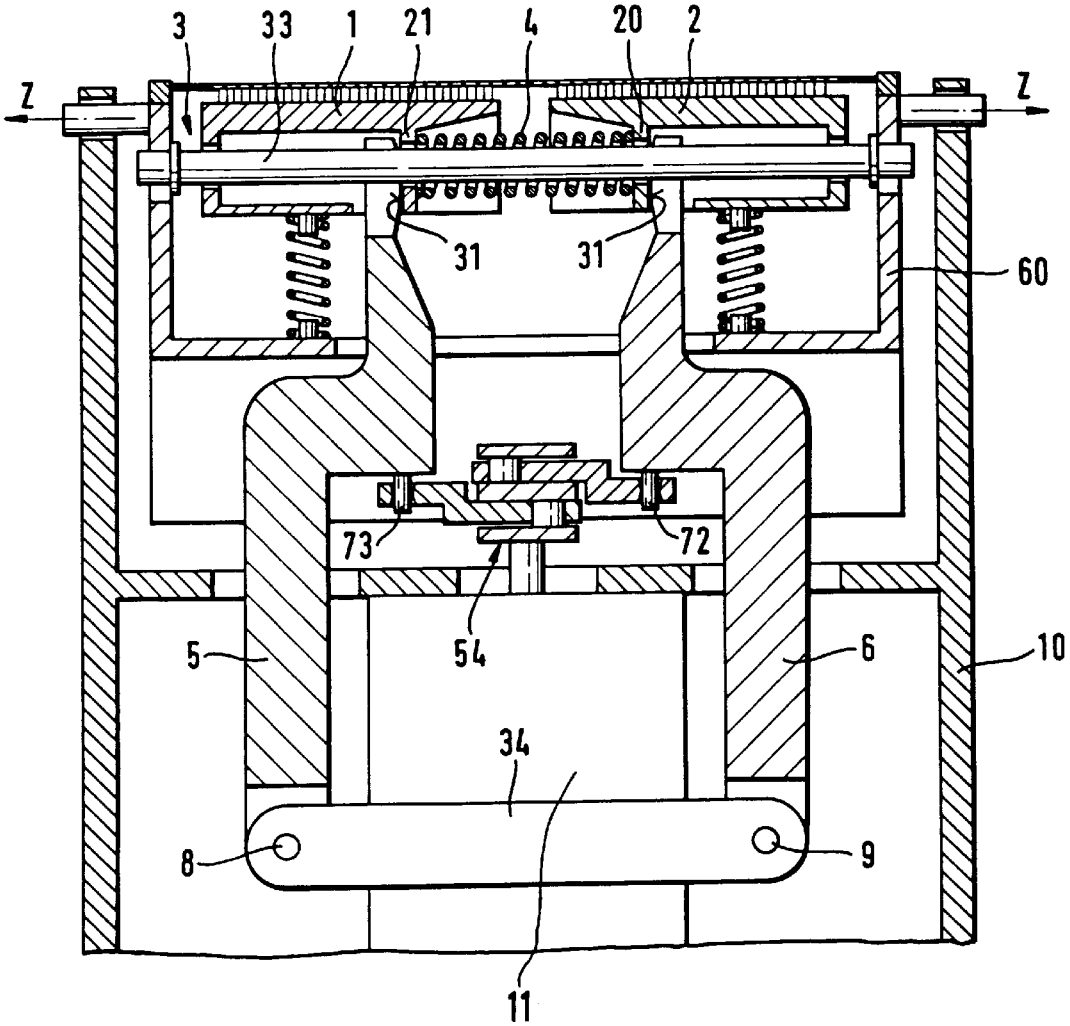
FIG. 10 is a view of a dry shaving apparatus substantially according to FIG. 9, showing drive levers acting on wall elements of the inner cutters and transmitting by means of a crank drive mechanism the driving motion to the inner cutters.

FIG. 10 shows an embodiment of a dry shaving apparatus corresponding largely to the embodiment of FIG. 9, the difference being that the inner cutters 1 and 2 arranged in a pivotal frame 60 for sliding movement on a guide element 3 under the action of a spring element 4 are set in a reciprocating movement by single-armed drive elements 5 and 6. The drive elements 5 and 6 configured as single-armed levers are pivotally mounted on the pins 8 and 9 of a pin support 34 fastened to the housing 10. The ends of the drive elements 5 and 6 remote from the pins 8 and 9 are provided with a respective roll-off cam 31 acting on a respective wall element 20, 21. The drive pins 72 and 73 are provided on the drive elements 5 and 6 approximately half-way between the axle 33 and the pins 8 and 9 and are connected to the crank levers 70 and 71 of a crank drive mechanism 54, as explained in the foregoing with reference to the embodiment of FIG. 8.

Figure 11:
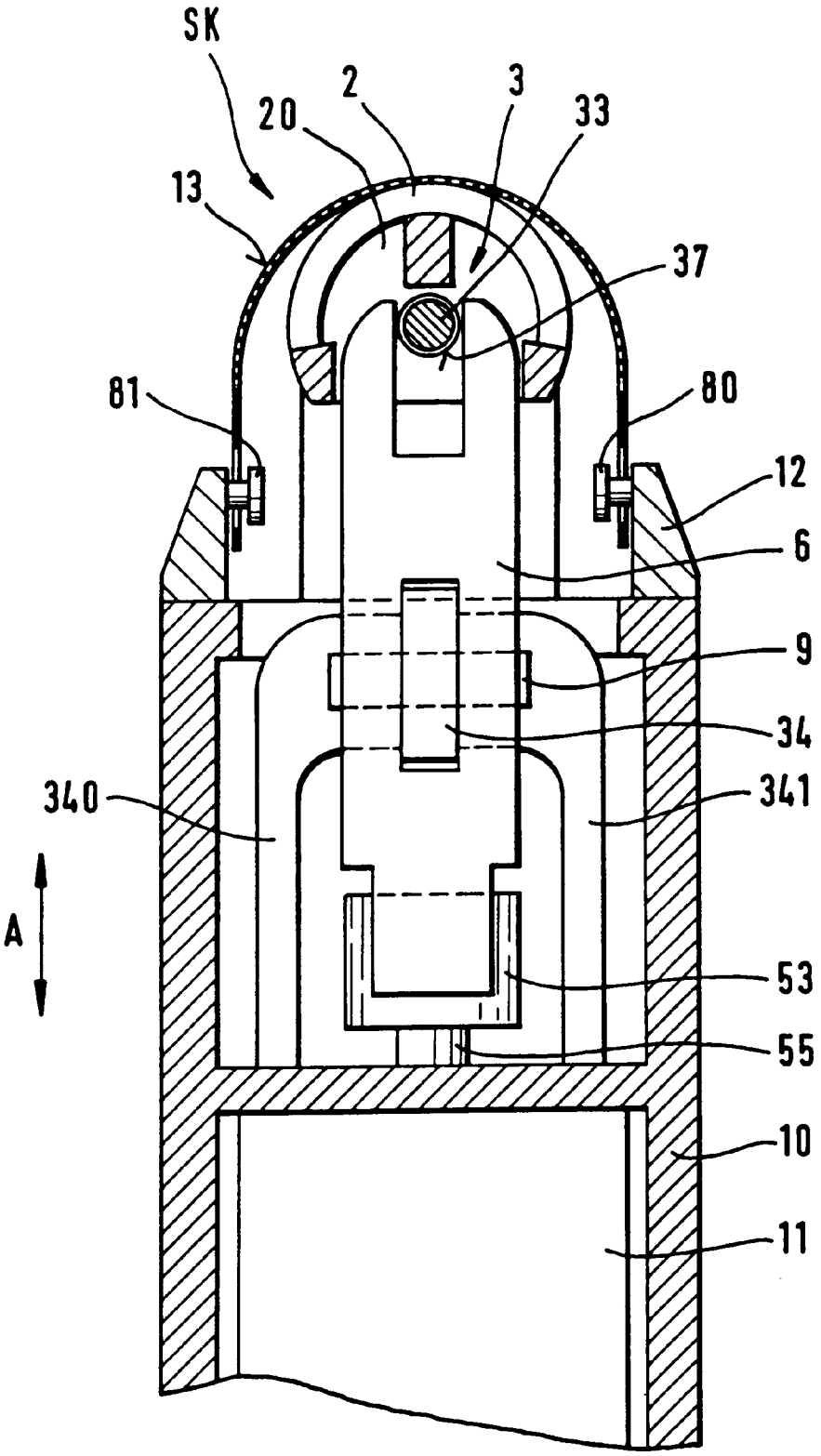
FIG. 11 is a sectional view of a dry shaving apparatus equipped with a shaving head having a foil movable up and down on the shaving head frame in and in opposition to the vertical direction.

FIG. 11 shows a side view in section of a dry shaving apparatus according to FIG. 1 and further embodiments previously described. Detachably or fixedly secured to the housing 10 is a shaving head frame 12. The shaving head frame includes an outer cutter 13 movably mounted in a vertical direction A by means of fastening elements 80 and 81. Alternatively, the outer cutter 13 may also be fixedly secured to the shaving head frame 12 by means of the fastening elements 80 and 81. The inner cutter 2 slidably arranged on a guide element 3 or an axle 33 is urged into engagement with the outer cutter 13 by means of a spring element 18—see FIG. 1. The axle 33 is passed through a bearing bore 37 provided in the wall element 20 of the inner cutter 2. The double-armed drive element 6 bears with a lever end against the wall element 20 of the inner cutter 2 to displace the inner cutter 2 against the action of a spring element 4— see FIG. 1. The double-armed drive element 6 is pivotally mounted on a pin 9, such that its end remote from the inner cutter 2, which is set in motion by a motor shaft of an electric motor 11, is in abutment with the expansion means 7 configured as rotor 53. The pin 9 is provided on a pin support 34 secured to a wall of the housing 10 by means of bracket arms 340, 341.

FIG. 12 shows a side view of a dry shaving apparatus with a shaving head assembly pivotally mounted about a pivot axis Z and including, for example, two shaving heads SK1 and SK2 configured as short-hair cutters arranged parallel to each other in a frame 60. The frame 60 is connected to a shaving head frame 12 in which, for example, an outer cutter 13 embracing the two inner cutters 2 is fixedly or movably secured in tension. The embodiment of the shaving head assembly of FIG. 12 presents essentially a duplication of the shaving head assembly of FIG. 11, FIG. 12 illustrating and describing a side view of the embodiment of FIG. 9. In a modification of the representation of FIG. 12, the outer cutter 13 may also be split in the middle, that is, beneath the pivot axis Z, being accordingly of a two-part configuration.

By means of journals 63, 64 in the bracket elements 14, 15, whereof the journal 64 and the bracket element 15 are illustrated in FIG. 12, the frame 60 is mounted for pivotal movement about the pivot axis Z. The axles 33 forming the guide elements 3 extend through the bearing bore 37 in the wall elements 20 of the inner cutters 2 and have their ends carried in the frame 60—see FIG. 9. The fork-shaped drive element 6 which is mounted so as to be pivotal about a pin 9 engages the wall elements 20 of the inner cutters 2 to set these in motion. The end of the double-armed drive element 6 remote from the two inner cutters has a bearing surface LF extending transversely to the vertical center line M for engagement with a rotor 53 driven by a motor shaft 55 of an electric motor 11. The lateral extent of the bearing surface LF is dimensioned such as to ensure driving of the inner cutters via the drive elements 5 and 6 in the course of the entire pivotal motion of the pivotally mounted shaving head assembly about the pivot axis Z. The embodiment of FIG. 12 shows clearly that further shaving heads SK may be provided in a frame 60 and driven by the drive mechanism described solely by the provision of additional fork ends to the drive elements 5 and 6.

Figure 13:
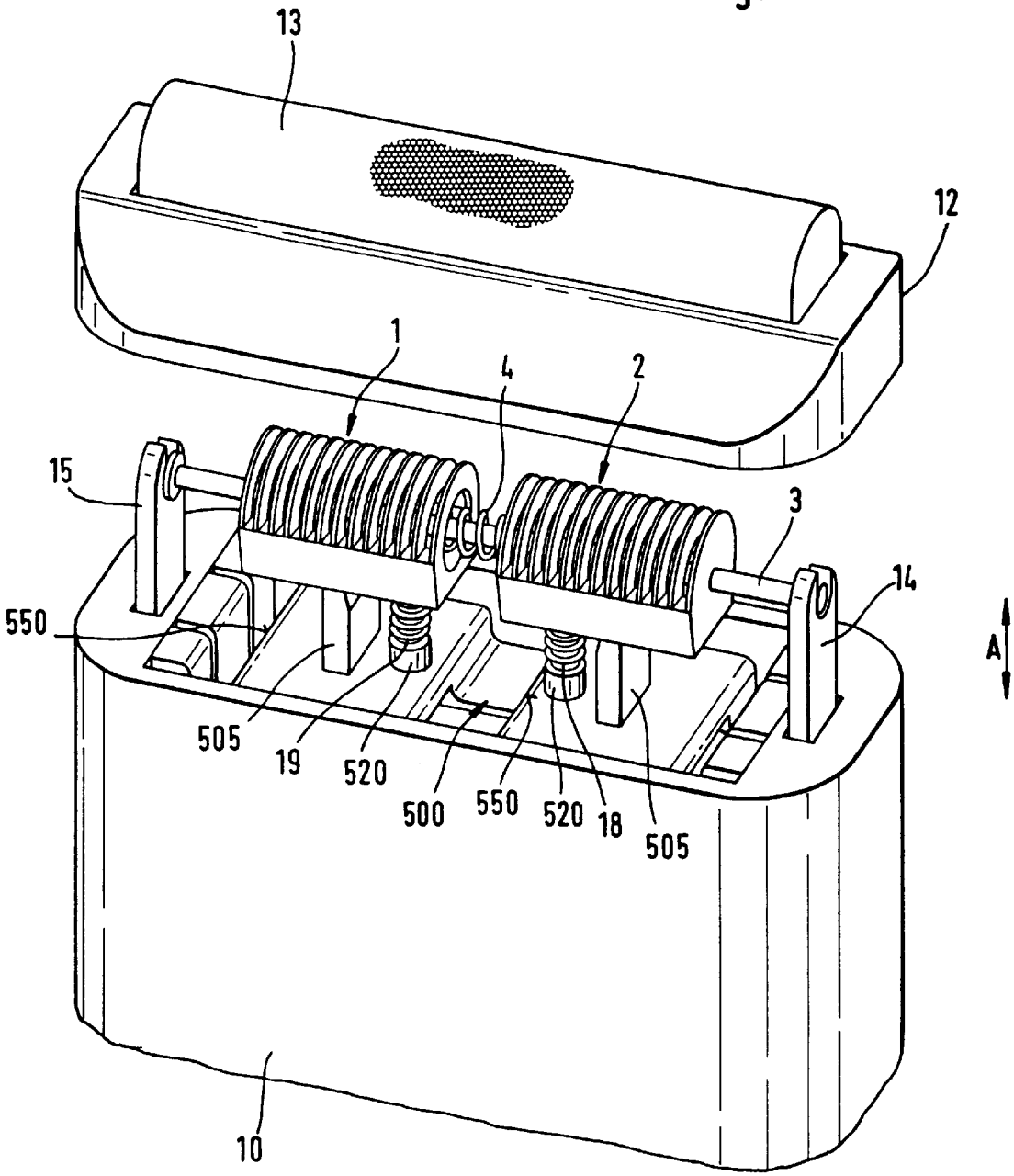
FIG. 13 is a perspective view of the upper part of a dry shaving apparatus showing the shaving head removed.

FIG. 13 is a perspective view of the upper part of a dry shaving apparatus, showing a shaving head frame 12 to which an outer cutter 13 is secured removed from the housing 10. The embodiment of the dry shaving apparatus of FIG. 13 differs from the embodiments of FIGS. 2 and 8 essentially in that the drive elements acting on the inner cutters 1 and 2 are formed by at least one oscillatory bridge structure 500 having at least two vibration elements 550 movable in relative opposite directions. Together with the spring element 4 acting on them, the inner cutters 1 and 2 operatively associated with the common outer cutter 13 are movably arranged on a common guide element 3. The guide element 3 is carried in bracket elements 14, 15 which are either spring-mounted in the housing 10 so as to be movable in and in opposition to the direction of the arrow A—see FIG. 8, or immovably arranged—see FIG. 1. Holding elements 520 for the spring elements 18 and 19 are provided on the vibration elements 550, movable in relative opposite directions, of the oscillatory bridge structure 500 in order to maintain the inner cutters 1 and 2 in engagement with the common outer cutter 13 with the requisite contact pressure.

Further details of the oscillatory bridge structure 500 will be explained with reference to FIGS. 14 and 15.

Figure 14:
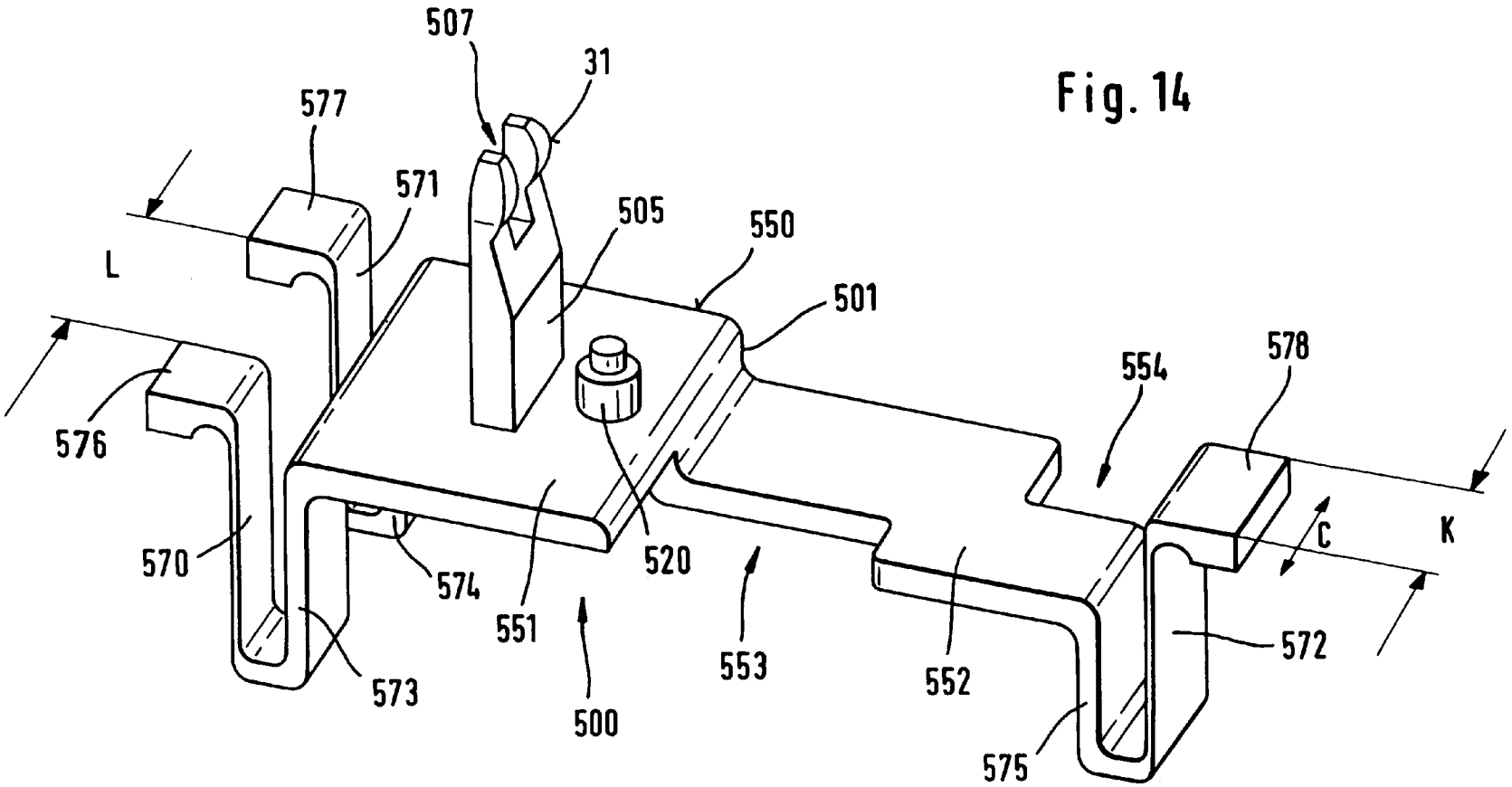
FIG. 14 is a perspective view of an oscillatory bridge structure.

FIG. 14 shows an oscillatory bridge structure 500 essentially comprising two vibration planes 551 and 552 extending in the horizontal direction of vibration of the inner cutters 1 and 2, the planes being formed by a step 501 and rigid bridge members 573, 574, 575 having vibration arms 570, 571 and 572 integrally formed thereon. The bridge members 573 and 574 with the vibration arms 570 and 571 are formed on the upper vibration plane 551, while the bridge member 575 with the vibration arm 572 is formed on the vibration plane 552. To secure the oscillatory bridge structure 500 directly to the housing 10 or indirectly to another component of the housing 10, holding elements 576, 577 and 578 are formed at the respective ends of the vibration arms 570, 571 and 572, such as to ensure vibration of the vibration planes 551, 552 in a plane. A respective recess 553 and 554 is provided in either longitudinal side of the bridge member forming the vibration plane 552. The dimensions of these lateral recesses 553 and 554, the relative distance L of the vibration arms 570 and 571, and the width K of the vibration arm 572 are dimensioned in such manner that two such oscillatory bridge structures 500 can be assembled together via these recesses and relative distances to form an oscillatory bridge unit—see FIG. 15.

Integrally formed on the vibration plane 551 of the oscillatory bridge structure 500 on the side close to the inner cutter are a holding element 520 for a spring element 18 or a spring element 19, and a motion-transmitting element 505 having a roll-off cam 31 for transmitting motion to an inner cutter and a U-shaped recess 507 for passage of a guide element carrying the inner cutters and the spring element.

Figure 15:
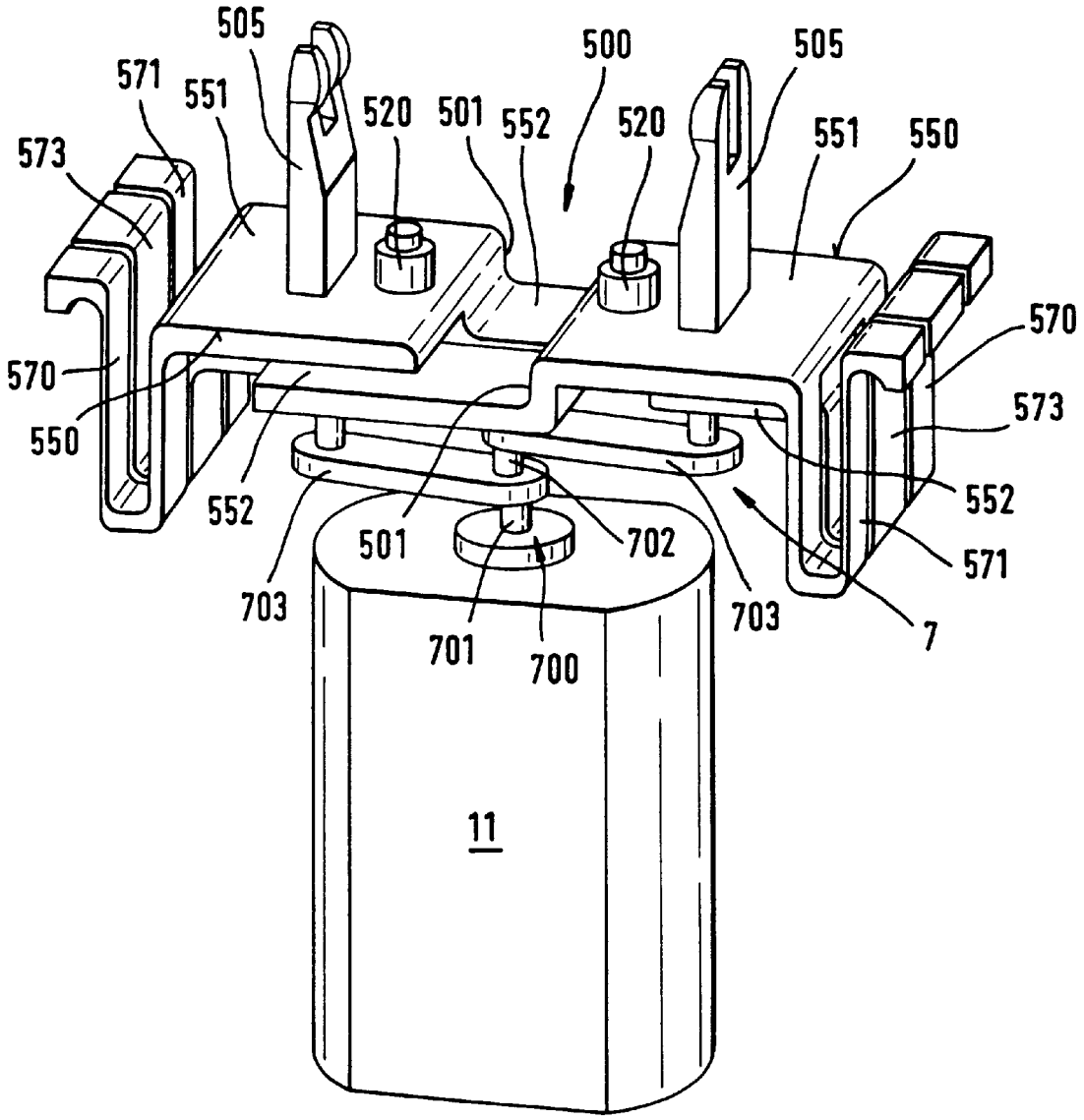
FIG. 15 is a perspective view of two drive elements configured as oscillatory bridge structures which are coupled to an electric motor via crank elements and a double eccentric device.

FIG. 15 shows two oscillatory bridge structures 500 of the type described with reference to FIG. 14 in assembled condition, each of these oscillatory bridge structures 500 being driven by an electric motor 11 and an expansion means 7. The expansion means 7 is, for example, a double eccentric device 700 having eccentric cams 701 and 702 in mutually opposing arrangement which are connected, through a respective crank element 703, to the lower vibration plane 552, closer to the electric motor 11, of the respective oscillatory bridge structure 500 in order to subject the vibration planes 551 and 552 to oscillation in relative opposite directions, said planes vibrating in a horizontal plane because of the steps 501.

In all embodiments illustrated and described, the transmission of the drive forces of the drive elements 5 and 6 to the inner cutters via the roll-off cam is symmetrical to the axis of symmetry of the inner cutters.

I claim:

1. A dry shaving apparatus comprising:

a housing:

an electric motor arranged in the housing; and a shaving head, said shaving head including a common outer cutter, bracket elements, a common guide member carried in the bracket elements, a drive element which is driven by the electric motor, two inner cutters which are operatively associated with the common outer cutter and which are arranged on the common guide member, and a spring mechanism which is guided on the common guide member and which urges the two inner cutters in opposite directions, wherein the drive element comprises an oscillatory bridge structure and is arranged to drive the two inner cutters in relative opposite directions against the forces of the spring mechanism.

2. The dry shaving apparatus as claimed in claim 1, wherein the drive element comprises two oscillatory bridge structures of identical construction having vibration elements operating in relative opposite directions.

3. The dry shaving apparatus as claimed in claim 2, wherein each of the two oscillatory bridge structures has a vibration element, the two vibration elements being movable in relative opposite directions to each other.

4. The dry shaving apparatus as claimed in claim 2, wherein the vibration element of each oscillatory bridge structure is divided into two vibration planes by a step formed therein.

5. The dry shaving apparatus as claimed in claim 1, wherein on the vibration element of each oscillatory bridge structure comprises at least one motion-transmitting element adapted to act upon a corresponding one of the two inner cutters.

6. The dry shaving apparatus as claimed in claim 5, wherein the drive element further comprises an expansion element coupled to the electric motor and wherein the vibration element of each oscillatory bridge structure drivable by the electric motor via said expansion element.

7. The dry shaving apparatus as claimed in claim 6, wherein the expansion element comprises a double eccentric device having eccentric cams in mutually opposing arrangement.

8. The dry shaving apparatus as claimed in claim 7, wherein the eccentric cams are connectable to a respective vibration element directly.

9. The dry shaving apparatus as claimed in claim 6, wherein the drive element further comprises two pins and two drive members pivotally mounted about respective ones of the two pins and wherein the expansion element is between two adjacent ends of the two drive members.

10. The dry shaving apparatus as claimed in claim 9, wherein the electric motor is a direct-current motor.

11. The dry shaving apparatus as claimed in claim 9, wherein the expansion element comprises a rotor having an elliptical guideway for the drive members.

12. The dry shaving apparatus as claimed in claim 9, wherein the expansion element comprises a crank drive mechanism.

13. The dry shaving apparatus as claimed in claim 1 wherein the shaving head further comprises at least one spring element holding the inner cutters in engagement with the outer cutter.

14. The dry shaving apparatus as claimed in claim 1, wherein the shaving head further comprises spring elements on which the brackets elements are mounted and holding the inner cutters in engagement with the outer cutter.

15. The dry shaving apparatus as claimed in claim 1 wherein the housing has a housing wall and the shaving head further comprises a spring element resting against the housing wall and holding each inner cutter in engagement with the outer cutter.

16. The dry shaving apparatus as claimed in claim 1, wherein the outer cutter is movably mounted.

17. The dry shaving apparatus as claimed in claim 16, wherein the outer cutter is pivotally mounted.

18. The dry shaving apparatus as claimed in claim 16, wherein the housing has a longitudinal axis defining a vertical direction and wherein the outer cutter is floatingly mounted in the vertical direction.

19. The dry shaving apparatus as claimed in claim 1, wherein the guide element comprises an axle and the spring element is arranged on the axle.

20. The dry shaving apparatus as claimed in claim 1, wherein the shaving head further comprises a frame carried in the bracket elements and wherein the guide element is carried in the frame.

21. The dry shaving apparatus as claimed in claim 20, wherein the frame is pivotally mounted in the bracket elements.

22. The dry shaving apparatus as claimed in claim 20, wherein the guide element is floatingly carried in the frame.

* * * * *